US007377994B2

(12) United States Patent
Ahvenniemi et al.

(10) Patent No.: US 7,377,994 B2
(45) Date of Patent: May 27, 2008

(54) METHOD AND DEVICE FOR THREADING A WEB IN THE REELING OF A PAPER OR BOARD WEB

(75) Inventors: Vesa Ahvenniemi, Helsinki (FI); Kenneth Widell, Helsinki (FI); Hannu Kasula, Kerava (FI); Seppo Laine, Espoo (FI); Bo Fagerström, Espoo (FI)

(73) Assignee: Metso Paper, Inc., Helsinki (FI)

( * ) Notice: Subject to any disclaimer, the term of this patent is extended or adjusted under 35 U.S.C. 154(b) by 481 days.

(21) Appl. No.: 10/524,092

(22) PCT Filed: Aug. 7, 2003

(86) PCT No.: PCT/FI03/00595

§ 371 (c)(1),
(2), (4) Date: Feb. 9, 2005

(87) PCT Pub. No.: WO2004/015198

PCT Pub. Date: Feb. 19, 2004

(65) Prior Publication Data

US 2005/0205225 A1 Sep. 22, 2005

(30) Foreign Application Priority Data

Aug. 9, 2002 (FI) ..... 20021459

(51) Int. Cl.
*D21F 7/00* (2006.01)
*B65H 18/08* (2006.01)
*B65H 20/12* (2006.01)

(52) U.S. Cl. ..... 162/118; 162/193; 162/283; 162/364; 162/368; 226/92; 242/542.4; 242/547

(58) Field of Classification Search ..... 162/193, 162/194, 286, 118, 120, 122, 255, 366–372, 162/283; 242/542.4, 547; 226/91, 92
See application file for complete search history.

(56) References Cited

U.S. PATENT DOCUMENTS 4,648,942 A 3/1987 Wanke et al.

(Continued)

FOREIGN PATENT DOCUMENTS

DE 199 46 379 A1 3/2001

(Continued)

OTHER PUBLICATIONS

International Search Report issued in PCT/FI03/00595, Dec. 2003.

(Continued)

*Primary Examiner*—Eric Hug
(74) *Attorney, Agent, or Firm*—Stiennon & Stiennon

(57) ABSTRACT

A web is threaded in the reeling of a paper or board web, by passing a web tail strip (W) into a reeling nip between a reeling drum (10) and a reel spool (12), on which a web roll is formed. The tail strip (W) is passed into the reeling nip by a suction zone (20) which extends substantially around the entire reeling drum circumference and is (10) in an area where a full-width web runs during reeling, so that the tail strip (w) can be conducted directly along the suction zone (20). The suction zone (20) is placed in the longitudinal direction of the reeling drum (10), i.e. in the width direction of the web.

16 Claims, 4 Drawing Sheets

U.S. PATENT DOCUMENTS

| | | | | | |
|---|---|---|---|---|---|
| 5,135,614 | A | * | 8/1992 | Aula et al. | 162/217 |
| 5,531,396 | A | * | 7/1996 | Kinnunen et al. | 242/526.3 |
| 5,873,180 | A | | 2/1999 | Grunder | |
| 5,915,648 | A | * | 6/1999 | Madrzak et al. | 242/615.2 |
| 6,325,320 | B1 | * | 12/2001 | Moller et al. | 242/532.7 |
| 6,413,374 | B1 | | 7/2002 | Laurikainen et al. | |

FOREIGN PATENT DOCUMENTS

| | | | | |
|---|---|---|---|---|
| EP | 0 658 504 | A2 | | 6/1995 |
| FI | 74446 | | | 10/1987 |
| FI | 98742 | | | 4/1997 |
| JP | 6-341089 | | * | 12/1994 |
| WO | WO 99/20834 | A1 | | 4/1999 |
| WO | WO 00/71453 | | * | 11/2000 |
| WO | WO 2004/015198 | A1 | | 2/2004 |

OTHER PUBLICATIONS

International Preliminary Examination Authority issued in PCT/FI03/00595, Nov. 2004.

* cited by examiner

METHOD AND DEVICE FOR THREADING A WEB IN THE REELING OF A PAPER OR BOARD WEB

CROSS REFERENCES TO RELATED APPLICATIONS

This application is a U.S. national stage application of international application No. PCT/FI2003/000595, filed Aug. 7, 2003, the disclosure of which is incorporated by reference herein and claims priority on Finnish Application No. 20021459, Filed Aug. 9, 2002.

STATEMENT AS TO RIGHTS TO INVENTIONS MADE UNDER FEDERALLY SPONSORED RESEARCH AND DEVELOPMENT

Not applicable.

BACKGROUND OF THE INVENTION

As known in the prior art, in connection with the reeling of a paper web, a reeling drum is used which is provided with suction zones of the sector type, i.e. suction takes place through holes situated in a suction drum shell only in part of the circumference of the drum in the area of a certain sector. One prior-art arrangement in the reeling of a paper web, using a reeling drum provided with a suction zone sector, is disclosed in FI patent 74446. In known arrangements in which the suction zone is formed into a sector, it is hardly at all possible to remove the boundary layer air flow produced by the rotating drum. In addition, the suction zone sector in known applications is situated outside the web in the length direction of the drum, i.e. in the width direction of the web, and for this reason during threading it has been necessary to guide the tail strip to the side, i.e. to the zone area, by means of blowing. In many cases, the location of the suction zone sector is also not optimal on the circumference of the drum because the tail strip typically misses the area of the suction sector in the threading operation. If the tail strip misses the suction zone, the tail strip slips out of the machine to the tending side, thus not entering the nip between the reeling drum and the reel spool, i.e. a holding/pulling point. The strip may also be directed towards the middle of the machine and it may slip into the nip from some unpredictable point. This leads to a random amount of loose strip. The tightening of the loose strip lengthens the time taken by threading unnecessarily. In many cases it does not even succeed, but breaks when it flaps and flutters into other structures of the machine. After unsuccessful threading attempts, the threading path must be cleared to remove broken tail strips in order that new attempts may be made, which in turn further increases the threading time unnecessarily. The arrangement known from FI patent 74446 is primarily intended to aid reeling in order that the reeling speed might be increased, when needed. This known arrangement does not teach threading of a web.

In the arrangements known from the prior art, the holes through which a suction effect is arranged to be produced, are generally placed in the ridges between the grooves of grooved drums.

With respect to the state of the art relating to the threading of a paper web in connection with finishing devices, reference may be made, for example, to FI patent 98742, which discloses a method and an apparatus for threading a paper web on a surface treatment line for paper. In this known arrangement, the paper guide rolls and the surface treatment roll of the surface treatment line are provided with a suction sector and a blow sector, and by using them it is possible to cause the tail strip to adhere reliably to the perforated surface of the roll by means of the suction sector, and by means of suction it is possible to assure the right direction of the draw of the tail strip as well as the guidability of the draw, and formation of an air film between the paper web and the roll is avoided by means of the blow sector, and the tail strip is separated from the roll surface by means of blowing.

With respect to the prior art, reference can also be made to U.S. Pat. No. 5,915,648 disclosing a perforated roll for guiding a flexible material web, in particular a paper web, which has a jacket and a hollow interior and a respective cover at each end of the jacket. The jacket has a plurality of passage openings for passage of air therethrough, and at least one impeller inside the interior of the roll having a suction side for drawing air into the roll through the passage openings.

SUMMARY OF THE INVENTION

An object of the invention is to create a method and a device for threading a web in connection with the reeling of a paper or board web, in which method and device the drawbacks of the known arrangements described above are eliminated or at least minimized.

A particular object of the invention is to create an arrangement which, when used, enables the tail strip to adhere very well to the reeling drum and ensures that the tail strip is guided to the reeling nip.

A further object of the invention is to provide an arrangement which enables the tail strip to be positioned in the suction zone of the reeling drum both in the circumferential direction and in the lateral direction.

In accordance with the invention, a suction zone is arranged in connection with a reeling drum, which suction zone extends over the entire circumference of the drum and is located in the area of the web in the width direction of the web, i.e. in the longitudinal direction of the drum, so that the tail strip of the web will also be positioned in the suction zone area also in the lateral direction without a transfer accomplished by means of blowings or the like. The strip is sought to be brought to the holding point as tight as possible, that is without looseness.

In accordance with an advantageous feature of the arrangement of the invention, the apertures for achieving a suction effect, i.e. suction holes, are arranged at the bottom of the grooves of a grooved drum, most appropriately with close spacing. By this means, the boundary layers produced by the rotating drum and the moving web can be eliminated or reduced so as to be insignificant, with the result that the threading operation takes place reliably.

In an arrangement in accordance with an advantageous embodiment of the invention, the boundary layer produced during one revolution of the reeling drum is removed during the same revolution and, at the same time, the air amount carried with the tail strip is sucked. In that connection, the air amount sucked through the suction zone preferably exceeds the air amount carried in the boundary layer of the drum, so that by means of this so-called oversucking of the boundary layer it is assured that a vacuum effect, i.e. a lower static pressure, extends beyond the boundary layer, whereby the tail strip can be brought closer to the drum and caused to adhere to the surface of the reeling drum. The air carried with the tail strip is also sucked by means of this so-called oversucking.

In the arrangement in accordance with the invention, the tail strip can be made to adhere to the reeling drum in a reliable manner and the tail strip goes into the nip in a reliable manner. When, in accordance with the invention, the suction zone is disposed within the web area in the width direction of the web, the tail strip can be brought to the suction zone of the reeling drum without a lateral shift, which means that no separate means are needed for moving the tail strip in the lateral direction. In addition, in the arrangement in accordance with the invention, the tail strip is always positioned in the suction zone in the circumferential direction because the suction zone extends over the entire circumference.

In accordance with an advantageous embodiment of the invention, suction holes are arranged at the bottom of the grooves, so-called venta grooves, provided in the drum, so that the paper adheres to the surface of the drum because in entering the nip there is no discontinuity in the pressure prevailing in the groove. By so placing the holes at the bottom of the groove, the force holding the web against the drum surface can be made greater because the area of the groove against the web is larger than that of a single hole. After the web has adhered to the surface of the drum, the pressure in the groove is roughly of the same order as in the case where the web would cover one hole.

In accordance with advantageous additional features of the invention, the width of the suction zone in the longitudinal direction of the drum, i.e. in the width direction of the web, is smaller than the width of the web, advantageously 2-4 times the width of the tail strip, the distance between the suction holes in the circumferential direction of the reeling drum is about 10-100 mm, preferably 15-25 mm, and the diameter of the suction apertures is 1-10 mm, advantageously 2-4 mm, the grooves of the reeling drum are, for example, 1-3 mm wide, typically 1.5-2.5 mm wide, and the depth of the grooves is 1-8 mm, typically 3.5-4.5 mm, and the distance between the grooves is 5-100 mm, typically 6-25 mm. The speed of air in the holes of the suction zone is 20-200 m/s, advantageously 50-100 m/s, and the air sucked through the suction zone is conducted out from a hole situated in the axle of the reeling drum or in another appropriate manner. The air is passed from the end of the axle along a tube to a blower or, alternatively, the air can be drawn from the end of the drum through the flange of the drum by means of a separate suction box, from which it is passed to a blower. Generally, the suction zone is at either edge of the paper machine in the area of a roll end, but it can also be situated on an arbitrary line between the edges of the machine.

In the following, the invention will be described in greater detail with reference to the figures in the appended drawings, but the invention is not by any means meant to be narrowly limited to the details of these figures.

DESCRIPTION OF THE PREFERRED EMBODIMENTS

Figure 1:
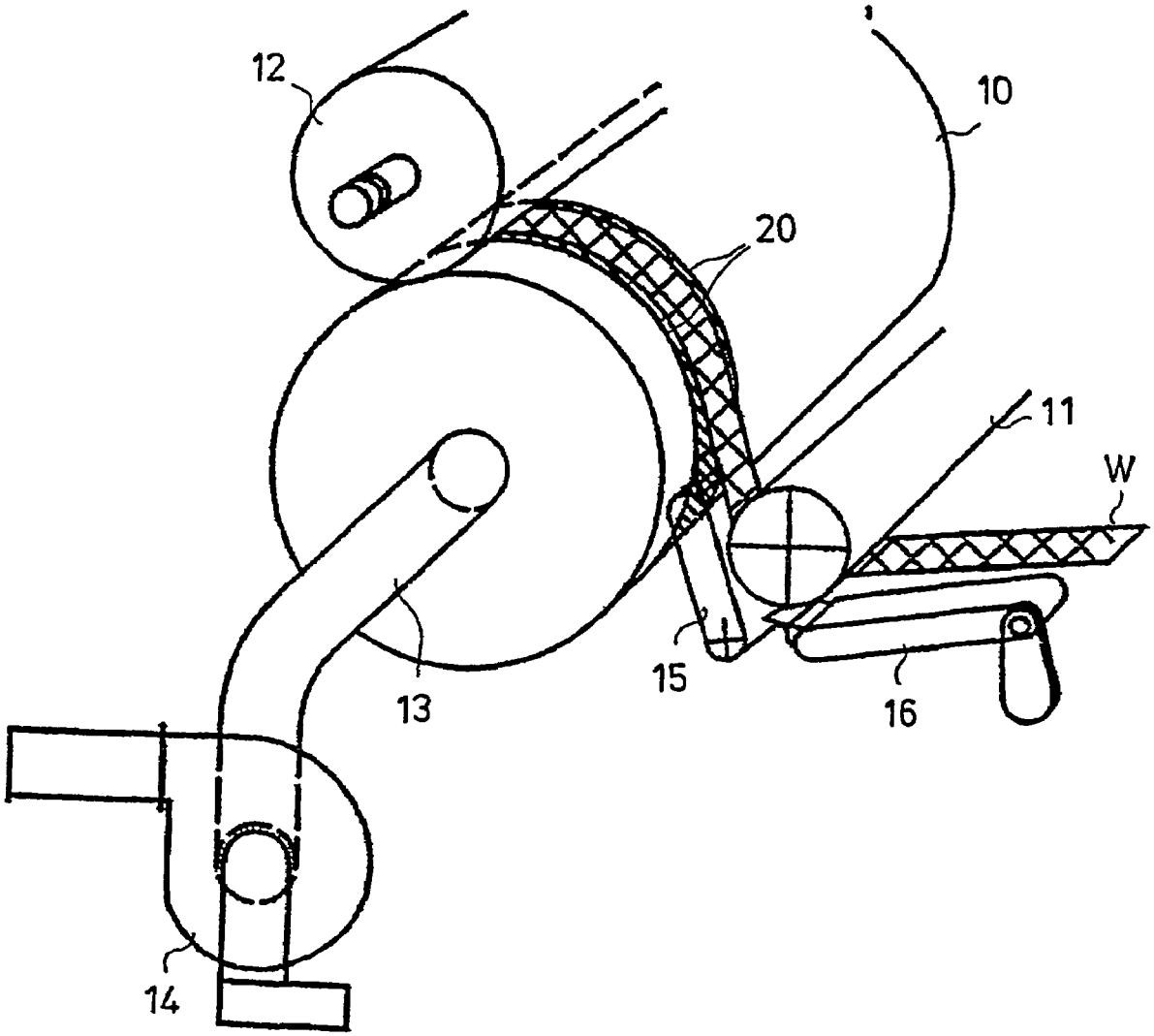
FIG. 1 schematically shows a tail strip threading situation on a reel-up in accordance with one advantageous exemplifying embodiment of the invention.

In the schematic view of the embodiment shown in FIG. 1, a tail strip W is passed in a threading situation in a reel-up via a paper guide roll 11 or equivalent to a reeling drum 10, on which it adheres to the surface of the reeling drum 10 by means of a suction zone 20 of the reeling drum 10 and by means of the suction zone 20 the web is passed to a reeling nip between the reeling drum 10 and a reel spool 12, from which nip the tail strip is turned onto the reel spool 12 to start a new reeling operation. Belt conveyors 15, 16, the operation of which is in itself known by a person skilled in the art, are arranged in the vicinity of the paper guide roll 11 for conducting the tail strip W. A suction tube 13 leads from one end of the reeling drum 10 to a blower 14 to produce a suction zone in the suction zone 20 by means of suction provided from inside the reeling drum. The suction zone 20 is placed in the reeling drum 10 in the longitudinal direction of the reeling drum 10, i.e. in the width direction of the web, in the area where a full-width web runs in the normal running situation (not shown).

Figure 2A:
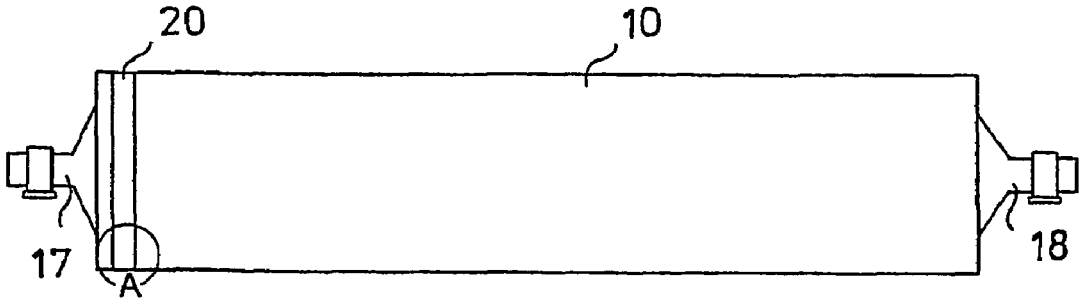
FIG. 2A is a schematic view of a reeling drum used in accordance with one exemplifying embodiment of the invention.

As shown in FIG. 2A, the reeling drum 10 comprises ends 17, 18, and a reeling drum shell (not shown), with space remaining inside it, is disposed around an axle between the ends 17,18. The suction zone 20 of the reeling drum 10 is placed in the vicinity of one end 17 of the reeling drum at a distance from the end 17 but in that area where the full-width web runs. The other end of the reeling drum 10 is denoted with the reference numeral 18.

Figure 2B:
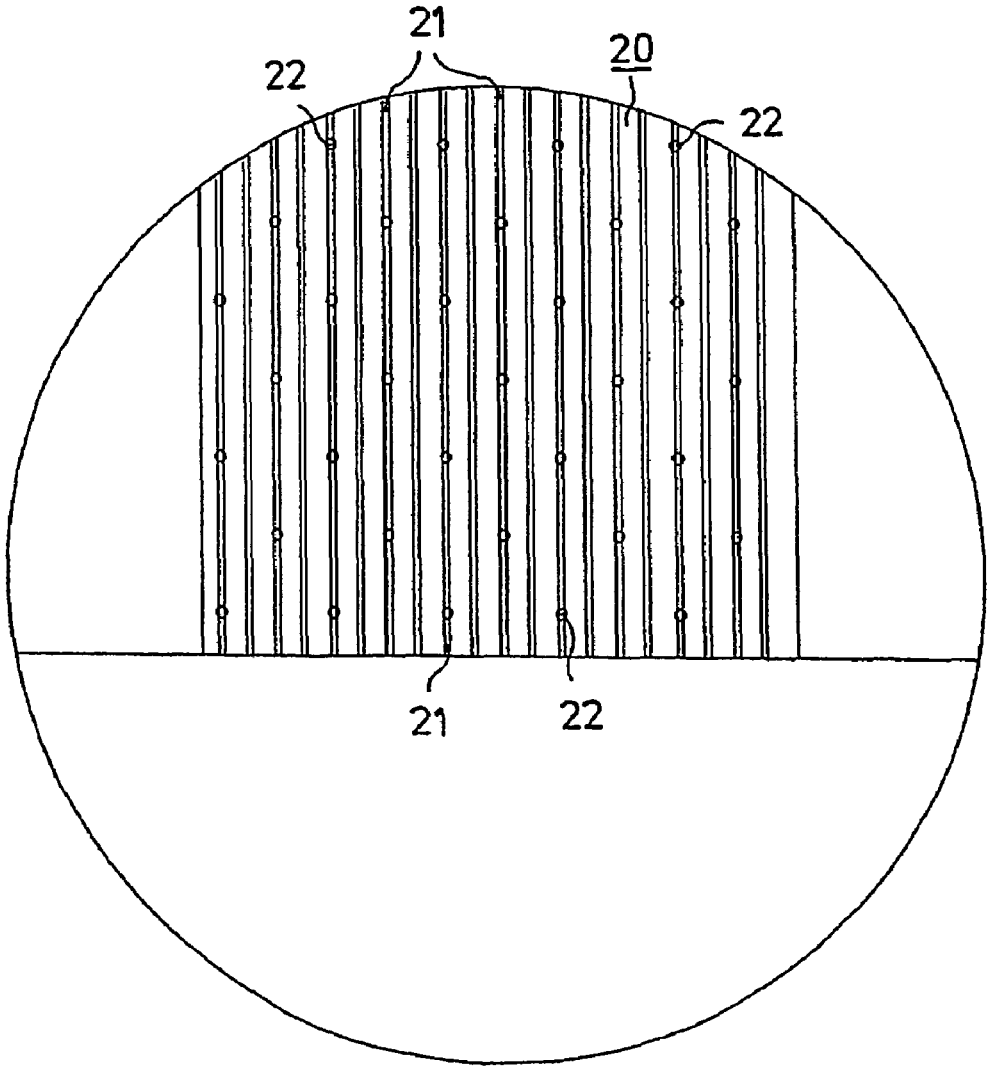
FIG. 2B schematically shows a partial enlargement of the area A in FIG. 2A.

In the schematic partial view of FIG. 2A shown in FIG. 2B, the area A shows that the suction zone 20 comprises grooves 21, i.e. so-called venta grooves, and suction holes 22 through which a suction effect is provided for the suction zone area on the surface of the reeling drum 10. As shown in FIG. 2B, the suction holes 22 are placed at the venta grooves 21.

Figure 2C:
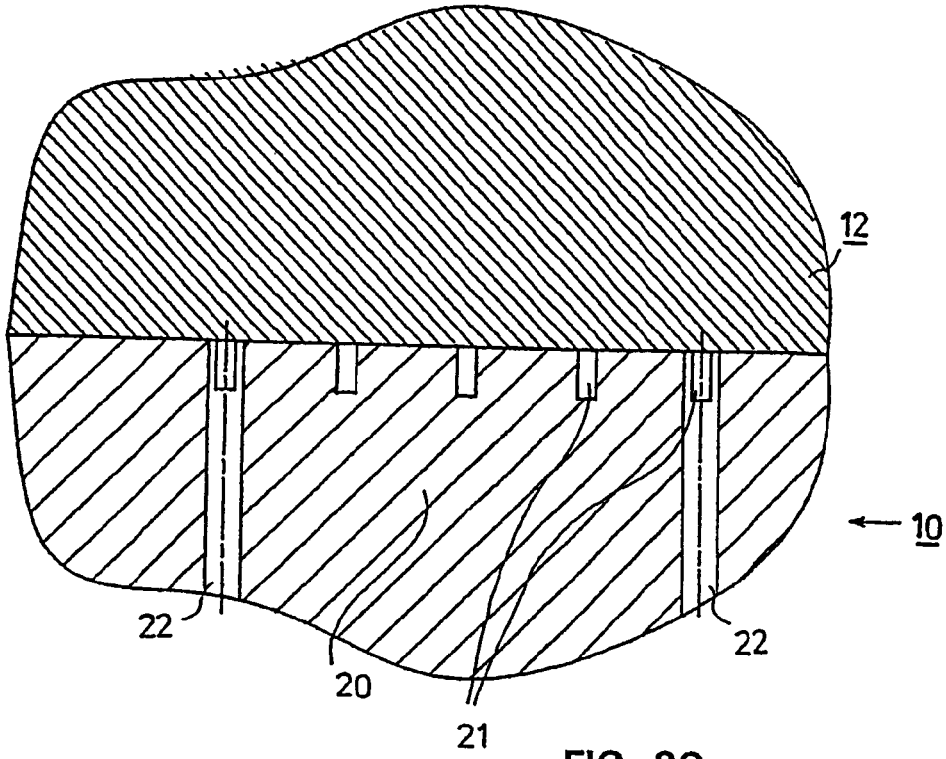
FIG. 2C is a schematic partial cross-sectional view of a nip between a reeling drum and a reel spool.

It is seen in the schematic partial view of FIG. 2C from the area of the suction zone 20 of the reeling drum 10, when the reeling drum 10 forms a nip with the reel spool 12, that the grooves 21 extend to a certain depth from the surface of the reeling drum 10 and the suction apertures, or the suction holes 22, are placed at the grooves 21, which suction holes extend through the shell of the reeling drum 10 to the inside of the shell of the reeling drum 10 to transmit a suction effect to the surface of the reeling drum 10.

Figure 3:
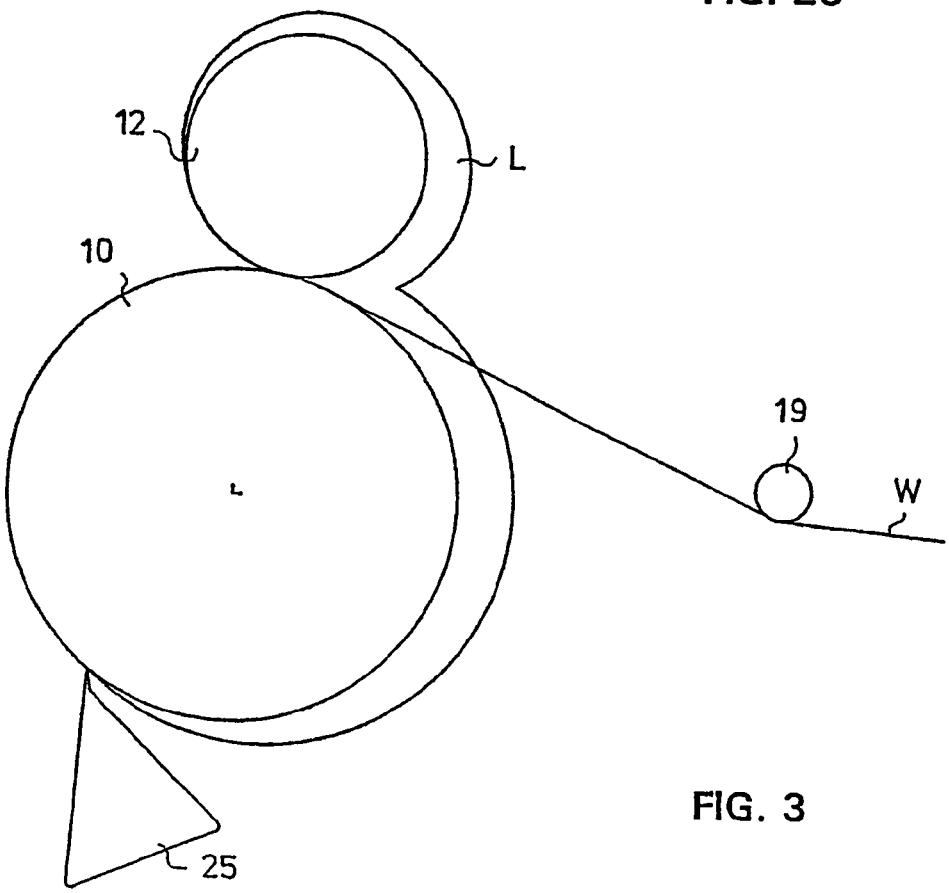
FIG. 3 schematically shows a boundary layer in a reel-up.

FIG. 3 schematically shows in a reel-up a boundary layer L which is formed in the reel-up in the area of the reeling drum 10 and the reel spool 12, which boundary layer is controlled in a threading situation by means of a suction zone in accordance with the invention such that the amount of air sucked through the suction zone exceeds the amount of air carried in the boundary layer L of the drum, thereby assuring a suction effect, i.e. a lower static pressure on the surface of the drum and in its vicinity, so that the tail strip can be brought closer to the drum and caused to adhere to the surface of the drum. The air carried with the tail strip is also sucked by means of the suction effect. In FIG. 3, a web guide roll is denoted with the reference numeral 19.

Figure 4:
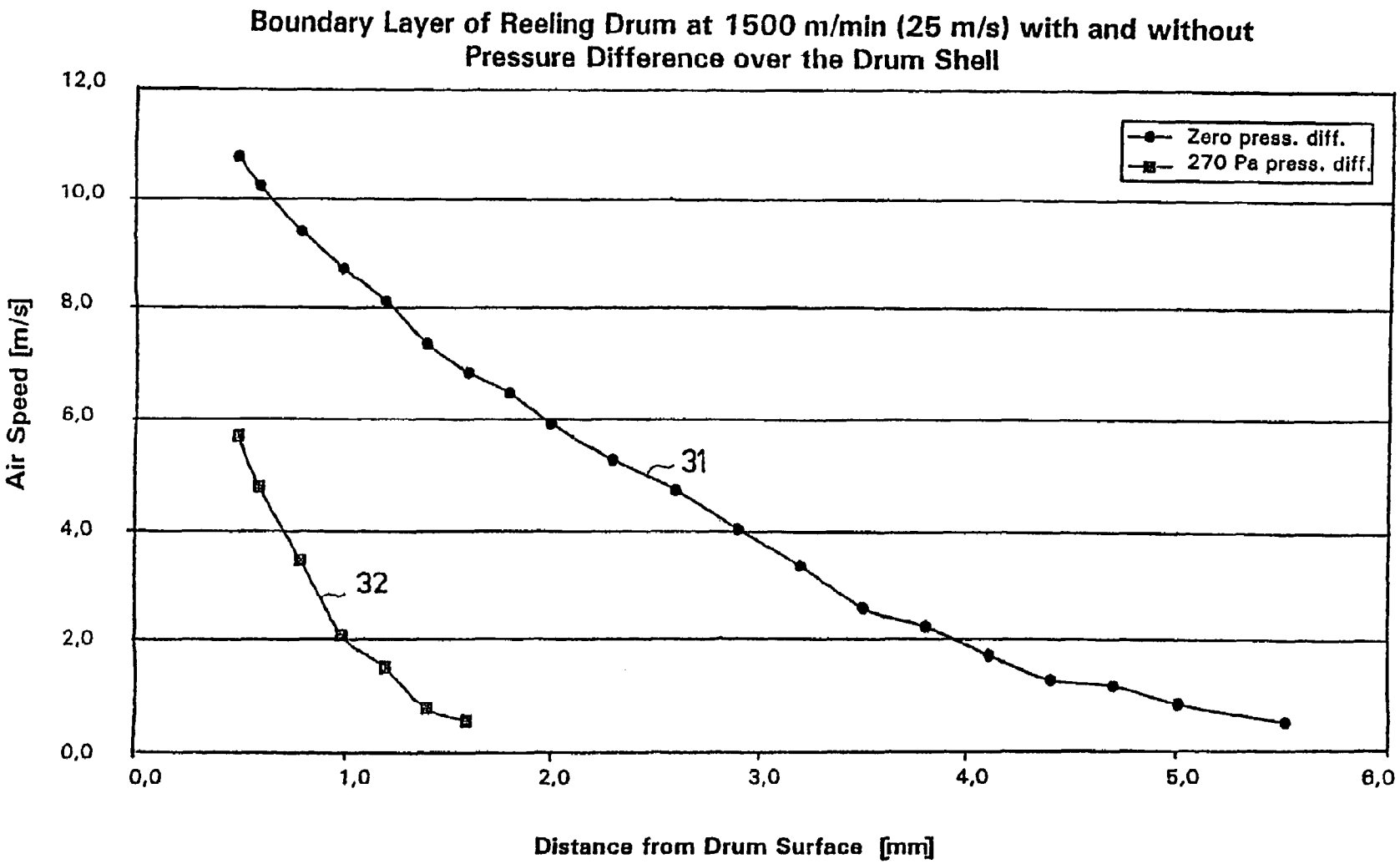
FIG. 4 schematically shows a measurement result relating to boundary layers of a reeling drum.

FIG. 4 shows some schematic measurement results relating to a boundary layer produced on a reeling drum in a trial situation in which the speed was 1500 m/min and when a pressure difference was effective over the reeling drum shell and when there was no pressure difference over the reeling drum shell. The curve 31 represents a situation when the pressure difference was 0 and the curve 32 represents a situation when the pressure difference was 270 Pa. The X axis represents the distance from the drum surface and the Y axis represents the speed of air in units m/s.

Above, the invention has been described only with reference to some of its advantageous exemplifying embodiments, to the details of which the invention is, however, not meant to be narrowly limited.

The invention claimed is:

1. A reeling device for threading a web in the reeling of a paper or board web, comprising:

a reeling drum, having a drum interior and a cylindrical reeling surface, portions of the cylindrical surface forming an area where a full-width web of a first selected width is arranged to run during reeling, the cylindrical surface defining a circumference;

a source of lower static pressure outside the reeling drum;

a reel spool forming a nip with the reel drum, the reel spool arranged to receive the paper or board web from the portions of the cylindrical surface forming an area where a full-width web is arranged to run, to form a web roll;

portions of the reeling drum forming a plurality of suction apertures extending between the drum interior and the reeling surface to provide a suction effect on the surface of the reeling drum, the suction apertures forming a suction zone which extends around the entire circumference of the reeling drum, and wherein the suction zone forms a part of the portions of the cylindrical surface forming the area where a full-width web is arranged to run during reeling; and wherein the drum interior is connected to the source of a lower static pressure outside the reeling drum by a tube connected to a hole situated in an axle of the reeling drum, the lower static pressure selected so that the suction zone holds a tail threading strip of a second selected width, cut from the paper or board web full width.

2. The device of claim 1, wherein the portions of the cylindrical surface forming an area where a full-width web is arranged to run during reeling form a plurality of circumferential grooves spaced along an axis defined by the cylindrical reeling surface; and wherein the suction apertures of the suction zone are situated at said grooves and in said grooves.

3. The device of claim 1 wherein the circumference of the cylindrical reeling surface defines a circumferential direction, and wherein the suction zone has a width transverse to the circumferential direction which is smaller than the first selected width of the web.

4. The device of claim 1 wherein the suction zone has a width which is two to four times the second selected width of the tail threading strip.

5. The device of claim 1 wherein the reeling drum has a first end of the reeling drum and a second end of the reeling drum and the cylindrical reeling surface positioned therebetween, and wherein the suction zone is closely spaced from one of the first end or the second end of the reeling drum.

6. The device of claim 1, wherein the source of a lower static pressure outside the reeling drum is a blower connected to the interior by the tube connected to the hole situated in an axle of the reeling drum, and through which hole and tube, air is transported to the blower.

7. The device of claim 1, wherein the source of a lower static pressure outside the reeling drum is connected though an end of the reeling drum by a suction box.

8. A reeling device for threading a web in the reeling of a paper or board web, comprising:

a reeling drum, having a drum interior and a cylindrical reeling surface, portions of the cylindrical surface forming an area where a full-width web of a first selected width is arranged to run during reeling, the cylindrical surface defining a circumference;

a reel spool forming a nip with the reel drum, the reel spool arranged to receive the paper or board web from the portions of the cylindrical surface forming an area where a full-width web is arranged to run, to form a web roll;

portions of the reeling drum forming a plurality of suction apertures extending between the drum interior and the reeling surface to provide a suction effect on the surface of the reeling drum, the suction apertures forming a suction zone which extends around the entire circumference of the reeling drum, and wherein the suction zone forms a part of the portions of the cylindrical surface forming the area where a full-width web is arranged to run during reeling;

wherein the drum interior is connected to a source of a lower static pressure outside the reeling drum, the lower static pressure selected so that the suction zone holds a tail threading strip of a second selected width, cut from the paper or board web full width; and wherein the circumference of the cylindrical reeling surface defines a circumferential direction, and the suction apertures of the suction zone are arranged with 15-25 mm spacing in the circumferential direction, and 6-25 mm spacing transverse to the circumferential direction.

9. A reeling device for threading a web in the reeling of a paper or board web, comprising:

a reeling drum, having a drum interior and a cylindrical reeling surface, portions of the cylindrical surface forming an area where a full-width web of a first selected width is arranged to run during reeling, the cylindrical surface defining a circumference;

a reel spool forming a nip with the reel drum, the reel spool arranged to receive the paper or board web from the portions of the cylindrical surface forming an area where a full-width web is arranged to run, to form a web roll;

portions of the reeling drum forming a plurality of suction apertures extending between the drum interior and the reeling surface to provide a suction effect on the surface of the reeling drum, the suction apertures forming a suction zone which extends around the entire circumference of the reeling drum, and wherein the suction zone forms a part of the portions of the cylindrical surface forming the area where a full-width web is arranged to run during reeling;

wherein the drum interior is connected to a source of a lower static pressure outside the reeling drum, the lower static pressure selected so that the suction zone holds a tail threading strip of a second selected width, cut from the paper or board web full width; and wherein the circumference of the cylindrical reeling surface defines a circumferential direction, and the distance between the suction apertures in the circumferential direction of the reeling drum is about 10-100 mm, and the diameter of the suction apertures is 1-10 mm.

10. A method for threading a web in the reeling of a paper or board web, comprising the steps of:

passing a tail threading strip cut from a paper or board web into a reeling nip between a reeling drum having a circumferential surface, and a reel spool, to form a web roll on the reel spool;

conducting the tail threading strip on the circumferential surface of the reeling drum and passing the paper or board web into said reeling nip between the reeling drum and the reel spool by attachment of the tail threading strip to a suction zone of the reel drum which extends entirely around the circumferential surface of the reel drum so that the tail threading strip is conducted directly along the suction zone situated on the circumferential surface of the reeling drum in an area where a full-width web runs during reeling;

drawing air through a plurality of suction apertures 1-10 mm in diameter, said apertures extending between an interior of the drum and the circumferential surface and connected to a source of a lower static pressure outside the reeling drum, wherein the air is drawn through said apertures at a speed of 20-200 m/s to provide the suction effect on the circumferential surface of the reeling drum, the suction apertures forming the suction zone; and wherein a boundary layer of air, produced by the rotating reeling drum and motion of the tail threading strip is substantially removed by a suction effect provided through the suction zone.

11. The method of claim 10, wherein the tail strip of the web is conducted to the reeling nip by the suction zone and wherein the suction zone is situated closely spaced from one end of the reeling drum.

12. The method of claim 10, wherein the circumferential surface has portions forming a plurality of circumferential grooves spaced along an axis defined by the circumferential surface, and wherein the suction apertures of the suction zone are situated at said grooves and in said grooves.

13. The method of claim 10 wherein the circumference of the cylindrical reeling surface defines a circumferential direction, and wherein the suction zone has a width transverse to the circumferential direction which is 2-4 times the width of the tail threading strip, and the suction zone has a width transverse to the circumferential direction which is smaller than the area where the full-width web runs during reeling.

14. The method of claim 10 wherein the reeling drum has a first end of the reeling drum and a second end of the reeling drum and the cylindrical reeling surface is positioned therebetween, and wherein the suction zone is closely spaced from one of the first end or the second end of the reeling drum.

15. The method of claim 10 wherein the air is drawn through said apertures at a speed of 50-100 m/s to provide the suction effect on the circumferential surface of the reeling drum, the suction apertures forming the suction zone.

16. The method of claim 10, wherein the source of a lower static pressure outside the reeling drum is connected through an end of the reeling drum by a suction box.

* * * * *